US006890111B2

(12) United States Patent
Kujirai

(10) Patent No.: US 6,890,111 B2
(45) Date of Patent: May 10, 2005

(54) TAB PAPER 2-SIDED PRINT METHOD, TAB PAPER 2-SIDED PRINT PROGRAM, COMPUTER READABLE STORAGE MEDIUM STORING PROGRAM, AND PRINT CONTROL APPARATUS

(75) Inventor: Yasuhiro Kujirai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/693,879

(22) Filed: Oct. 28, 2003

(65) Prior Publication Data

US 2004/0083917 A1 May 6, 2004

(30) Foreign Application Priority Data

Oct. 30, 2002 (JP) ..... 2002-316400

(51) Int. Cl.[7] ..... B41J 5/30

(52) U.S. Cl. ..... 400/61; 400/62; 400/76; 402/79; 283/41; 40/360

(58) Field of Search ..... 400/61, 62, 70, 400/76, 188; 358/1.18, 1.2, 1.15; 281/36–38; 283/37, 41; 402/79; 40/359, 360

(56) References Cited

U.S. PATENT DOCUMENTS

| | | | | | |
|---|---|---|---|---|---|
| 5,792,297 | A | * | 8/1998 | Hunter et al. | 156/211 |
| 5,924,812 | A | * | 7/1999 | Goldman | 402/79 |
| 5,996,130 | A | * | 12/1999 | Verhines | 40/361 |
| 6,071,030 | A | * | 6/2000 | Hunter et al. | 402/79 |
| 6,501,562 | B1 | | 12/2002 | Nakagiri et al. | 358/1.2 |
| 6,594,033 | B1 | | 7/2003 | Kujirai et al. | 358/1.18 |
| 6,654,509 | B1 | | 11/2003 | Nishikawa et al. | 382/298 |
| 2002/0180822 | A1 | | 12/2002 | Aritomi | 347/19 |
| 2003/0026626 | A1 | * | 2/2003 | Sunada et al. | 399/82 |

* cited by examiner

*Primary Examiner*—Minh Chau
(74) *Attorney, Agent, or Firm*—Fitzpatrick, Cella, Harper & Scinto

(57) ABSTRACT

In a printing apparatus, it is checked if a tab paper print setup is made. If it is determined that the tab paper print setup is made, it is checked if the face to be printed is the obverse or reverse face. If it is determined that the face to be printed is the obverse face, first drawing data is generated; if face to be printed is the reverse face, second drawing data is generated by adjusting the first drawing data.

10 Claims, 18 Drawing Sheets

FIG. 11

| | |
|---|---|
| TOTAL NUMBER OF PHYSICAL PAGES | 1101 |
| TOTAL NUMBER OF LOGICAL PAGES | 1102 |
| NUMBER OF SETS OF COPIES | 1103 |
| COPY SET PRINT | 1104 |
| FINISHING INFORMATION | 1105 |
| ADDITIONAL PRINT INFORMATION | 1106 |

TAB PAPER 2-SIDED PRINT METHOD, TAB PAPER 2-SIDED PRINT PROGRAM, COMPUTER READABLE STORAGE MEDIUM STORING PROGRAM, AND PRINT CONTROL APPARATUS

FIELD OF THE INVENTION

The present invention relates to a print control apparatus, tab paper 2-sided print method, program, and storage medium and, more particularly, to generation and print control of a tab in a system which comprises an information processing apparatus such as a personal computer or the like, and a printer.

BACKGROUND OF THE INVENTION

A tab paper sheet is a paper sheet with a "tab" indicating an item or title to an A4 or letter paper sheet, and so-called "10-tab style" with 10 tabs, "5-tab style" sheets with five tabs, and the like are prevalent. The standard size of a tab portion is ½" in case of the letter size, but some tab paper sheets have tabs of other sizes. Compared to a normal paper sheet, since a tab is attached and a tab paper sheet is normally formed of a paperboard and often causes paper jam at a convey system in a conventional printing apparatus, most of the conventional printing apparatuses do not support a print process on tab paper sheets. However, in recent years, since the technology of sheet convey systems has improved, a printing apparatus can perform a tab paper print process. A printing apparatus called a multi-function machine having a printer function and the like can print a tab generated on a computer via a printer driver.

However, a printing apparatus can only perform a 1-sided print process on tab paper sheets, but cannot normally perform a 2-sided print process due to its convey system. Since the tab paper sheet is made up of a paperboard, it is technically very difficult to reverse the sheet in the 2-sided print process.

However, since items or titles to be printed on tabs of tab paper sheets represent the contents of documents divided by these sheets, it is very important that they can be confirmed from the reverse face side, i.e., they are printed on the reverse faces.

In order to conquer such physical limitation (i.e., a paperboard cannot be reversed) of the printing apparatus, the following method may be adopted. That is, a tab paper sheet with a tab, one face of which has undergone a print process, is removed from printouts output onto an exhaust tray, and is manually reversed. Then, the reversed tab paper sheet is set on a sheet feed tray or manual insert tray to print only on the reverse face of the tab paper sheet. In such case, the tab direction must be constant with respect to the sheet convey direction in terms of the mechanism of the printing apparatus.

FIGS. 4A and 4B show the relationship between the sheet convey direction and tab document direction. The arrows in FIGS. 4A and 4B indicate the convey direction, and dots in FIGS. 4A and 4B indicate the upper side of the document direction.

FIG. 4A shows an example of the state of tab paper sheets and data to be printed on the obverse face side, and FIG. 4B shows an example of the state of tab paper sheets and data to be printed on the reverse face side.

When sheets are set so that tabs line up from the upper side, as shown in FIG. 4A, tab documents for five pages are prepared in the order of "TAB1", "TAB2", "TAB3", "TAB4", and "TAB5".

On the other hand, when sheets are set so that tabs line up from the upper side with respect to the document direction upon printing on the reverse faces of tab paper sheets, as shown in FIG. 4B, tab documents for five pages are prepared in the order of "TAB5", "TAB4", "TAB3", TAB2", and TAB1", opposite to that on the obverse side. Such method is very inconvenient, and the user often sets paper sheets in a wrong order.

In order to match tab information to be printed on the obverse face side with that on the reverse side, the user must prepare for two different documents, i.e., a tab layout for the obverse face and that for the reverse face.

SUMMARY OF THE INVENTION

According to the present invention, whether or not a tab paper print mode is set is checked. If it is determined that the tab paper print mode is set, it is determined if the face to be printed is the obverse or reverse face. If it is determined that the face to be printed is the obverse face, first drawing data is generated; otherwise, second drawing data is generated by adjusting the first drawing data.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 11 shows an example of the data format to be passed upon issuing a print request of physical pages from the spool file manager 304 to the despooler 305;

DETAILED DESCRIPTION OF THE PREFERRED EMBODIMENTS

Preferred embodiments of the present invention will now be described in detail in accordance with the accompanying drawings.

<Arrangement of Printer Control System>

Figure 1:
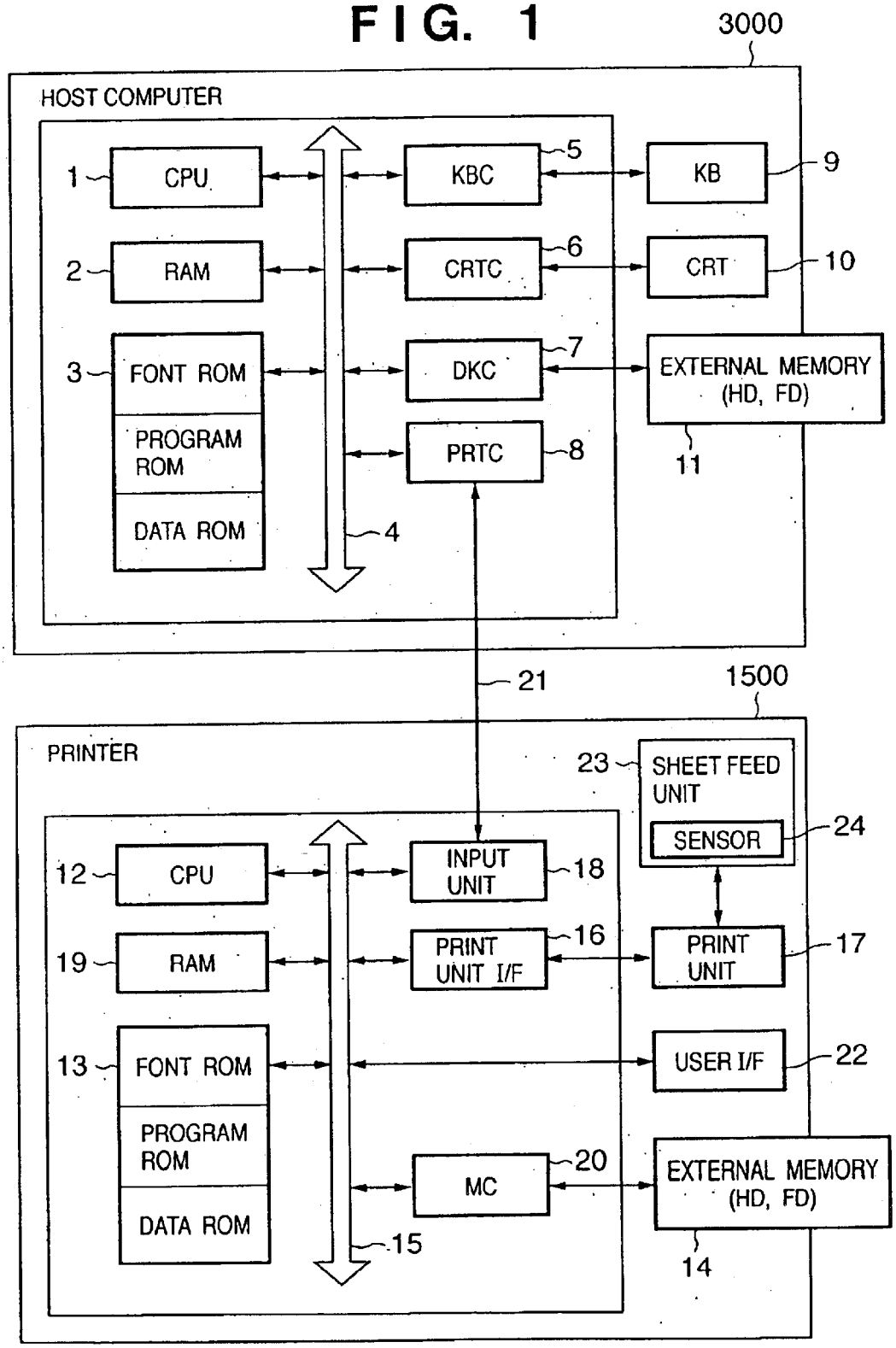
FIG. 1 is a block diagram for explaining the arrangement of a print system according to an embodiment of the present invention.

FIG. 1 is a block diagram for explaining the arrangement of a host computer and printer in a printer control system (print system) according to an embodiment of the present invention. Note that the present invention can be applied to any of a standalone apparatus, a system consisting of a plurality of apparatuses, and a system in which apparatuses are connected via a network such as a LAN, WAN, or the like to execute processes, as long as the functions of the present invention can be implemented.

Referring to FIG. 1, a host computer 3000 comprises a CPU 1 which executes a document process including graphic data, image data, text data, and table data (including spreadsheet data or the like) together on the basis of a document processing program stored in a program ROM of a ROM 3 or an external memory 11. The CPU 1 systematically controls devices connected to a system bus 4.

The program ROM of the ROM 3 or the external memory 11 stores an operating system program (to be referred to as an OS hereinafter) and the like as a control program of the CPU 1. A font ROM of the ROM 3 or the external memory 11 stores font data and the like used in the document process. A data ROM of the ROM 3 or the external memory 11 stores various data used upon executing the document process and the like. A RAM 2 serves as a main memory, work area, and the like of the CPU 1.

A keyboard controller (KBC) 5 controls key inputs from a keyboard 9 and a pointing device (not shown). A CRT controller (CRTC) 6 controls display on a CRT display (CRT) 10. A disk controller (DKC) 7 controls access to the external memory 11 such as a hard disk (HD), floppy® disk (FD), and the like, which stores a boot program, various applications, font data, user files, edit files, a printer control command generation program (to be referred to as a printer driver hereinafter), and the like. A printer controller (PRTC) 8 is connected to a printer 1500 via a two-way interface (interface) 21, and executes a communication control process with the printer 1500.

Note that the CPU 1 executes an outline font rasterize process onto a display information RAM assured on, e.g., the RAM 2, thus allowing WYSIWYG on the CRT 10. Also, the CPU 1 opens various registered windows on the basis of commands designated by a mouse cursor (not shown) or the like on the CRT 10, and executes various data processes.

Figure 18:
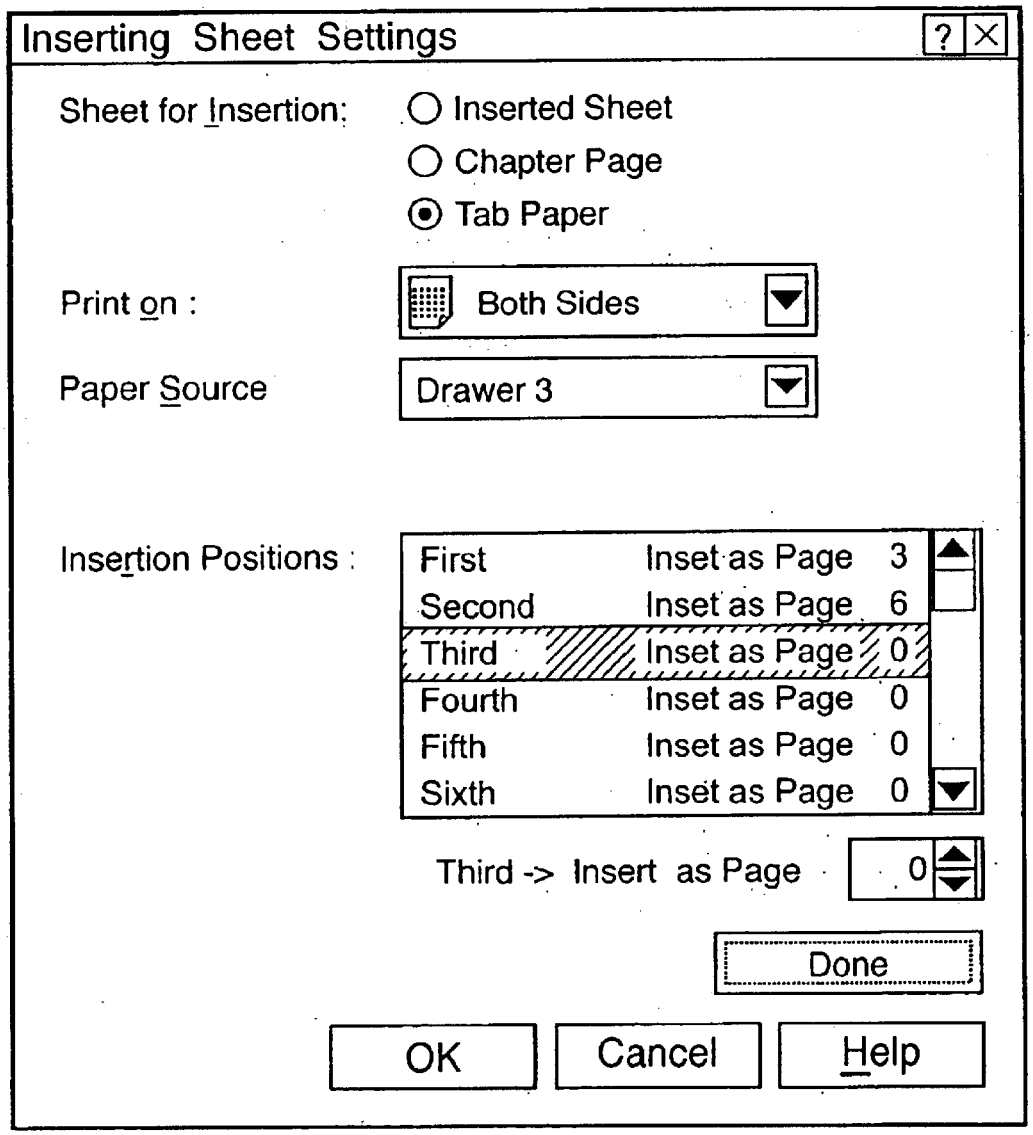
FIG. 18 shows an example of a GUI used in the 2-sided print mode of tab paper sheets.

Upon executing a print process, the user opens a window that pertains to print setups, and can make setups of a print process method for the printer driver, which includes printer setups and print mode selection. FIG. 18 shows an example of a GUI which is displayed on the CRT display 10 of the host computer 3000 upon executing a 2-sided print process on tab paper sheets. On the GUI shown in FIG. 18, "Both Sides" as Print style of tab paper is selected for "Print on", "Drawer3" is selected as a paper source that feeds tab paper sheets in a sheet feed unit 23, and the third and sixth pages are selected as insertion positions of tab paper sheets.

In FIG. 1, the printer 1500 is controlled by a CPU 12. The printer CPU 12 outputs an image signal as output information to a print unit (printer engine) 17 connected to a system bus 15 on the basis of a control program and the like stored in a program ROM of a ROM 13 or a control program and the like stored in an external memory 14.

The program ROM of the ROM 13 stores a control program and the like of the CPU 12. A font ROM of the ROM 13 stores font data and the like used upon generating the output information. A data ROM of the ROM 13 stores information and the like used on the host computer in case of a printer which does not have any external memory 14 such as a hard disk or the like.

The CPU 12 can execute a communication process with the host computer via an input unit 18, and can inform the host computer 3000 of information in the printer and the like. A RAM 19 serves as a main memory, work area, and the like of the CPU 12, and its memory size can be expanded by an option RAM connected to an expansion port (not shown). Note that the RAM 19 is used as an output information rasterize area, environment data storage area, NVRAM, and the like.

A memory controller (MC) 20 controls access to the external memory 14 such as a hard disk (HD), IC card, or the like. The external memory 14 is connected as an option, and stores font data, an emulation program, form data, and the like. Reference numeral 22 denotes a user interface on which a display screen used to display a warning message (to be described later) (this display screen may be of touch panel type), switches for various operations, an OK button used to issue a print command to the printer, LED indicators, and the like are arranged.

The number of external memories 14 is not limited to one, and a plurality of external memories 14 may be connected. That is, option cards and external memories that store programs used to interpret printer control languages of different language systems in addition to internal font data may be connected. Furthermore, an NVRAM (not shown) may be connected, and may store printer mode setup information from the user interface 22.

A print unit 17 performs a print process based on an electrophotography method or ink-jet method. In case of the electrophotography method, the print unit 17 mainly comprises a photosensitive drum as an image carrier, a charging roller for uniformly charging the surface of the photosensitive drum to a predetermined polarity and potential, an image information exposure unit such as a laser beam scanner or the like for forming an electrostatic latent image by scanning and exposing the uniformly charged surface of the photosensitive drum, a developing unit for developing the electrostatic latent image on the photosensitive drum as a toner image, a transfer roller for sequentially and electrostatically transferring the toner image formed on the photosensitive drum onto a print sheet fed from the sheet feed unit 23, a fixing unit for fixing the toner image on the print sheet, an exhaust unit for exhausting the print sheet on which the toner image is fixed, and the like.

The sheet feed unit 23 comprises a plurality of sheet-feed stages including a manual insert tray, cassettes, and the like, as storage units that store print sheets including tab paper sheets. Each sheet feed stage comprises a sensor 24 for detecting the presence/absence of print sheets.

Figure 2:
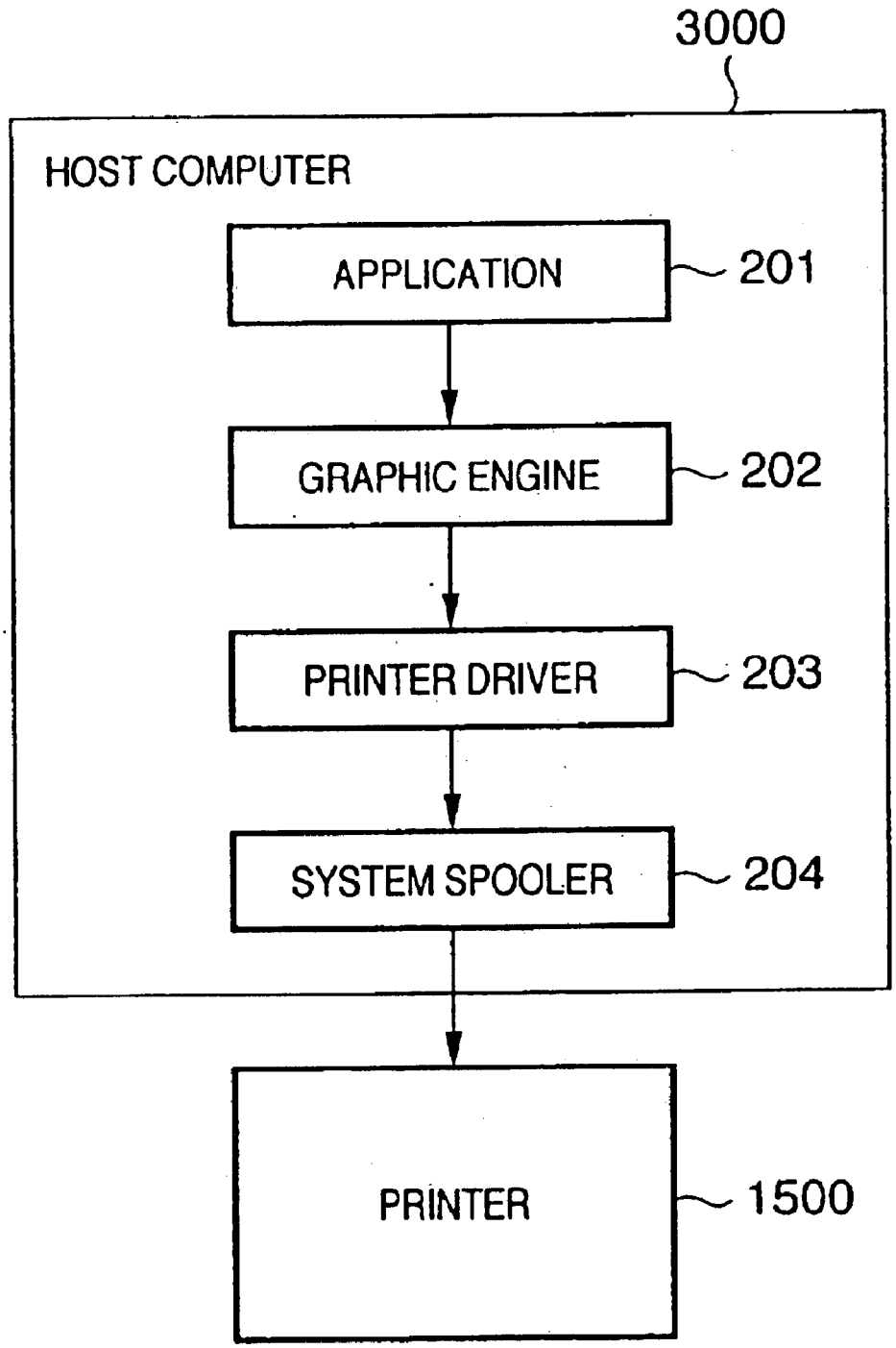
FIG. 2 is a diagram showing an example of the software module configuration required to implement a print process in a host computer.

FIG. 2 is a diagram of the software module configuration required to implement a typical print process in a host computer to which a printing apparatus such as a printer or the like is connected directly or via a network. An application 201, graphic engine 202, printer driver 203, and system spooler 204 are program modules, which are present as files saved in the external memory 11, and are loaded onto the RAM 2 by the OS or other modules that exploit those modules when they are executed. The application 201 and printer driver 203 can be added to the HD of the external memory 11 via the FD of the external memory 11, a CD-ROM (not shown), or a network (not shown).

The application 201 saved in the external memory 11 is loaded onto the RAM 2 upon execution. When this application 201 issues a print command to the printer 1500, an output (drawing) process is executed using the graphic engine 202 which is similarly loaded onto the RAM 2 and is ready to execute.

The graphic engine 202 loads the printer driver 203 prepared for each printing apparatus from the external memory 11 onto the RAM 2, and sets an output from the application 201 in the printer driver 203. The graphic engine 202 converts a GDI (Graphic Device Interface) function received from the application 201 into a DDI (Device Driver Interface) function, and outputs the DDI function to the printer driver 203.

The printer driver 203 converts the DDI function received from the graphic engine 202 into a control command that the printer can interpret, e.g., PDL (Page Description Language) data. The converted printer control command is output as print data to the printer 1500 via the system spooler 204 loaded onto the RAM 2 by the OS and an interface 21.

The print system of this embodiment further has an arrangement for temporarily spooling print data from the application as intermediate code data, as shown in FIG. 2, in addition to the print system which comprises the printer and host computer shown in FIG. 1.

<Print-Related Software Module in this Embodiment>

Figure 3:
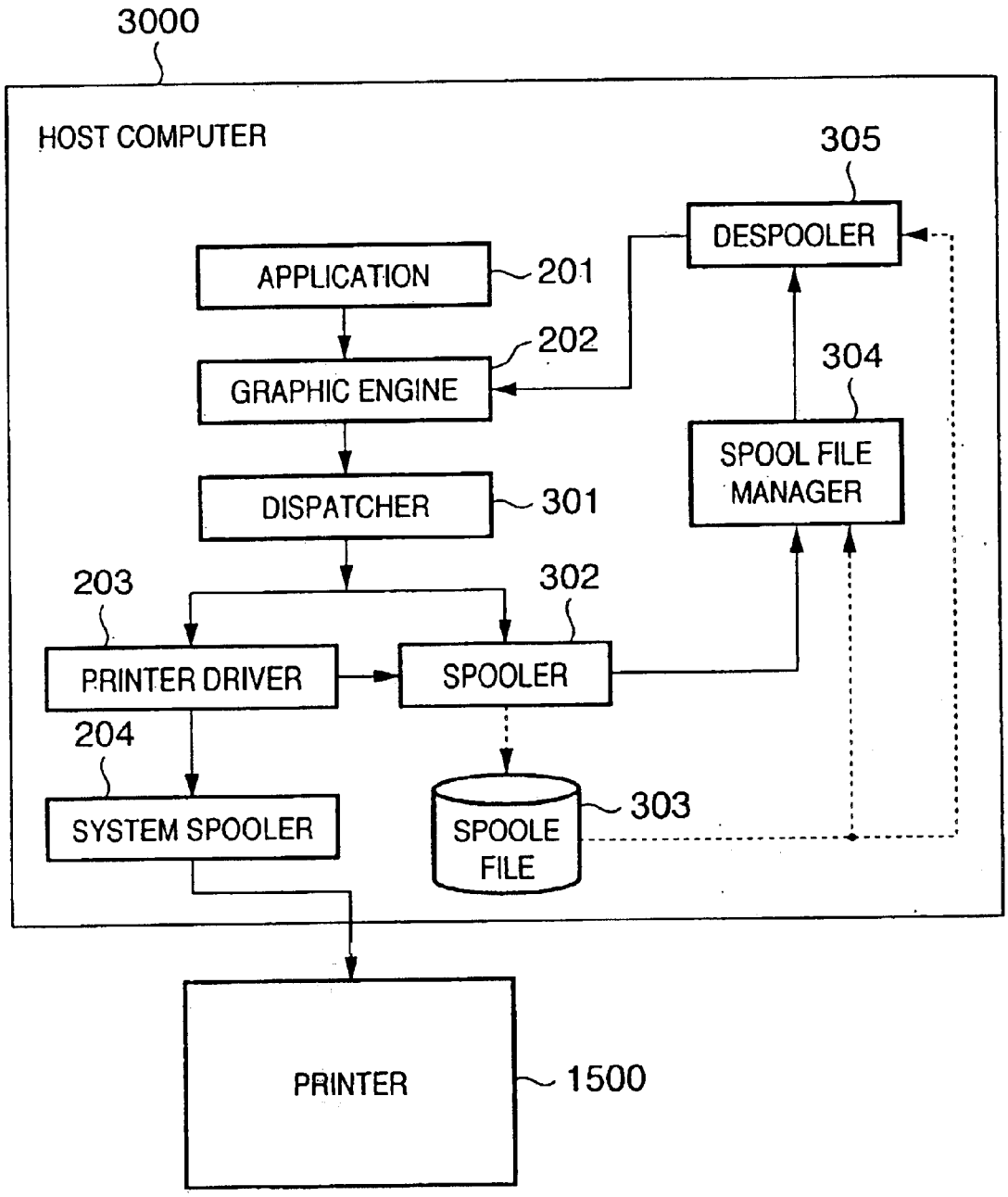
FIG. 3 is a diagram showing another example of the software module configuration required to implement a print process in a host computer.
Figure 4A:
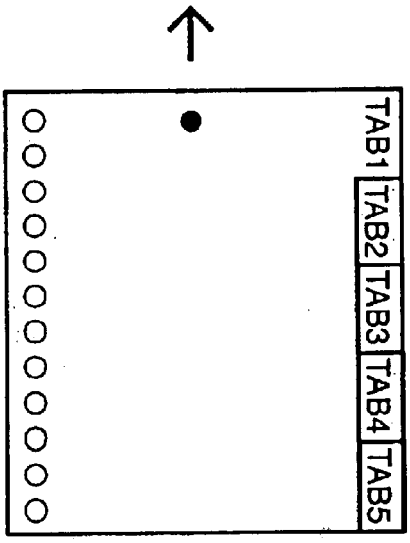
FIGS. 4A and 4B show the relationship between the sheet convey direction and tab document direction.
Figure 4B:
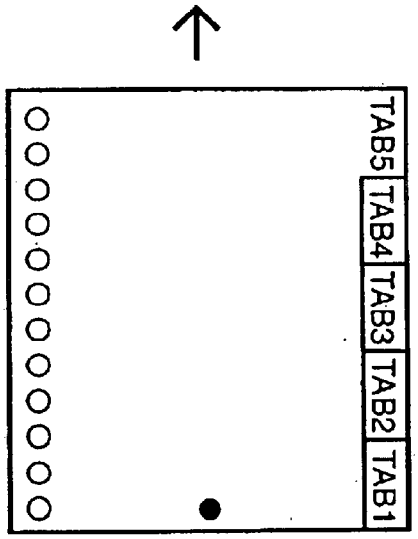

FIG. 3 is a diagram showing the software module configuration obtained by expanding the system shown in FIG. 2. In FIG. 3, upon sending a print command from the graphic engine 202 to the printer driver 203, a spool file 303 of an intermediate code is generated. In the system shown in FIG. 2, the application 201 is released from the print process after the printer driver 203 has converted all print commands from the graphic engine 202 into control commands of the printer.

By contrast, in the system shown in FIG. 3, the application 201 is released from the print process when a spooler 302 has converted all print commands into intermediate code data, and output them to the spool file 303. Normally, the latter process requires a shorter time than the former process.

In the module configuration shown in FIG. 3, the contents of the spool file 303 can be processed. As a result, functions such as a tab paper print function, an enlargement/reduction function, a function of printing a plurality of pages on one page in a reduced scale, and the like, that the application does not have can be implemented for print data from the application.

In order to process print data, the user makes setups from a window provided by the printer driver 203, which saves the setup contents on the RAM 2 or external memory 11.

Details of FIG. 3 will be explained below. As shown in FIG. 3, in this expanded processing system, a print command from the graphic engine 202 is received by a dispatcher 301. If the print command (DDI function) received from the graphic engine 202 is based on a print command (GDI function) issued from the application 201 to the graphic engine 202, the dispatcher 301 loads the spooler 302 stored in the external memory 11 onto the RAM 2, and sends the print command (DDI function) to the spooler 302 in place of the printer driver 203.

The spooler 302 interprets the received print command, converts it into an intermediate code for each page, and outputs that code to the spool file 303. The spool file 303 of an intermediate code stored for each page will be referred to as a page description file (PDF) hereinafter.

Also, the spooler 302 acquires processing setups (Nup, tab paper print, 2-sided print, staple, color/monochrome designation, etc) associated with print data, which are set in the printer driver 203, from the printer driver 203, and saves them as a file for each job in the spool file 303. The setup file set for each job will be referred to as a job description file (to be often abbreviated as SDF) hereinafter.

This job description file will be described later. Note that the spool file 303 is generated as a file on the external memory 11, but may be generated on the RAM 2. Furthermore, the spooler 302 loads a spool file manager 304 stored on the external memory 11 onto the RAM 2, and informs the spool file manager 304 of the generation state of the spool file 303. After that, the spool file manager 304 checks based on the processing setup contents saved in the spool file 303 if a print process can be executed.

When the spool file manager 304 determines that the print process can be executed using the graphic engine 202, it loads a despooler 305 stored in the external memory 11 onto the RAM 2, and instructs the despooler 305 to execute a print process of the page description file of the intermediate code described in the spool file 303.

The despooler 305 processes the page description file of the intermediate code contained in the spool file 303 in accordance with the job description file including process setup information contained in the spool file 303 to re-generate a GDI function, and the GDI function via the graphic engine 202 again.

If the print command (DDI function) received from the graphic engine 202 is based on a print command (GDI function) issued from the despooler 305 to the graphic engine 202, the dispatcher 301 sends a print command to the printer driver 203 in place of the spooler 302.

The printer driver 203 generates a printer control command described in a page description language or the like on the basis of the DDI function acquired from the graphic engine 202, and outputs it to the printer 1500 via the system spooler 204.

<Save Process of Print Intermediate Data>

Figure 5:
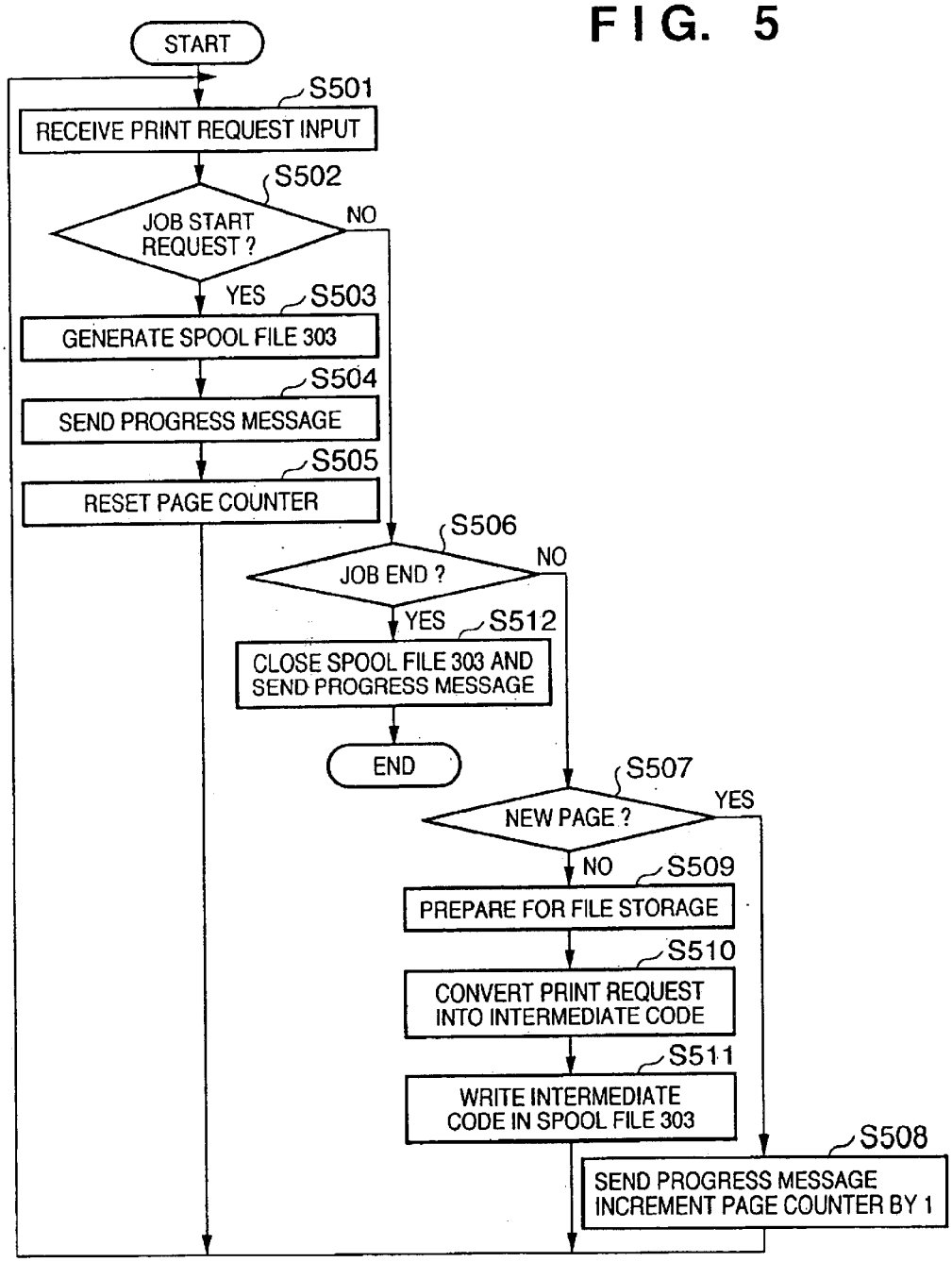
FIG. 5 is a flow chart showing the process in a spooler 302.

FIG. 5 is a flow chart showing the process in a save step for each page upon generating the spool file 303 in the spooler 302.

In step 501, the spooler 302 accepts a print request from the application via the graphic engine 202. The application displays a dialog used to input print setups, and the printer driver passes the print setups input using this dialog to the spooler 303.

The spooler 302 determines in step 502 whether or not the accepted print request is a job start request. If it is determined that the accepted print request is a job start request, the flow advances to step 503, and the spooler 302 generates a spool file 303 used to temporarily save intermediate data.

The spooler 302 informs the spool file manager 304 of the progress of the print process in step 504, and resets its page counter to 1 in step 505.

The spool file manager 304 loads and stores job information, process setups, and the like for a job, the print process of which has started, from the spool file 303.

On the other hand, if it is determined in step 502 that the accepted print request is not a job start request, the flow advances to step 506. The spooler 302 determines in step 506 whether or not the accepted request is a job end request. If it is determined that the accepted request is not a job end request, the flow advances to step 507 to check if the accepted request is a new page request.

If it is determined in step 507 that the accepted request is a new page request, the flow advances to step 508, and the spooler 302 informs the spool file manager 304 of progress of the print process. The spooler 302 then increments the page counter, closes a page description file that stores the intermediate code, and generates the next page description file.

If it is determined in step 507 that the accepted print request is not a new page request, the flow advances to step 509, and the spooler 302 prepares to save an intermediate code in the page description file. In order to store the print request in the spool file 303, the spooler 302 converts the DDI function of the print request into an intermediate code in step 510. In step 511, the spooler 302 writes the print request (intermediate code) that has been converted into a storable format in step 510 in the page description file of the spool file 303.

After that, the flow returns to step 501 to accept the next print request from the application. The spooler 302 repeats a series of processes from step 501 to step 511 until it receives a job end request (End Doc) from the application. At the same time, the spooler 302 acquires information such as process setups and the like stored in a DEVMODE structure from the printer driver 203, and stores the acquired information in the spool file 303 as a job description file.

If it is determined in step 506 that the print request from the application is a job end request, since all print requests from the application are complete, the flow advances to step 512 to inform the spool file manager 304 of progress of the print process, thus ending the process.

<Generation of Spool File>

Figure 6:
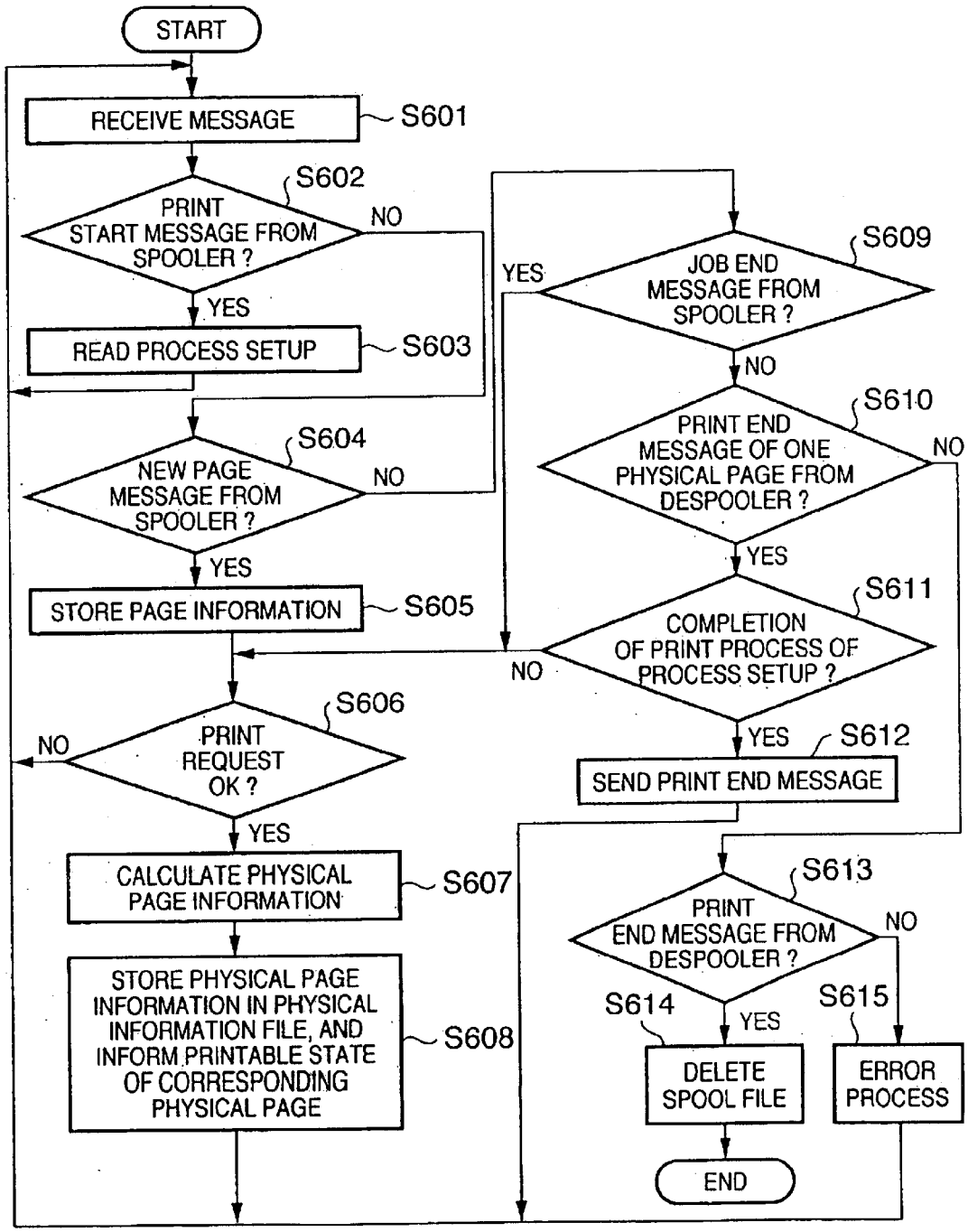
FIG. 6 is a flow chart showing print control in a spool file manager 304.

FIG. 6 is a flow chart showing details of the control between the generation process of the spool file 303 and that of print data (to be described later) in the spool file manager 304.

In step 601, the spool file manager 304 accepts the progress message of the print process from the spooler 302 or despooler 305. The spool file manager 304 checks in step 602 if the progress message is a print start message sent from the spooler 302 in step 504 above. If YES in step 602, the flow advances to step 603, and the spool file manager 304 reads the print process setups from the spool file 303 to start job management.

The tab paper print setups in the present invention are stored in the spool file 303, and the spool file manager 304 can read them in step 603.

On the other hand, if the spool file manager 304 determines in step 602 that the progress message is not a print start message from the spooler 302, the flow jumps to step 604 to check if the progress message is a print end message of one logical page sent from the spooler 302 in step 508 above. If YES in step 604, the flow advances to step 605, and the spool file manager 304 stores logical page information for that logical page.

The spool file manager 304 checks in step 606 if a print process of one physical page for n logical pages which have been spooled at that time can be started. If YES in step 605, the flow advances to step 607 to determine a physical page number on the basis of the number of logical pages assigned to one physical page to be printed.

As for calculation of physical pages, for example, when the process setups designate to lay out four logical pages per physical page, the first physical page is ready to print when the fourth logical page has been spooled, and the first physical page is determined at that time. Subsequently, the second physical page is ready to print when the eighth logical page has been spooled.

Even when the total number of logical pages is not a multiple of the number of logical pages to be laid out per physical page, logical pages to be laid out per physical page can be determined by the spool end message in step 512. However, since a tab paper print process is to be made in this embodiment, the number of logical pages to be laid out per physical page is 1.

Figure 8:
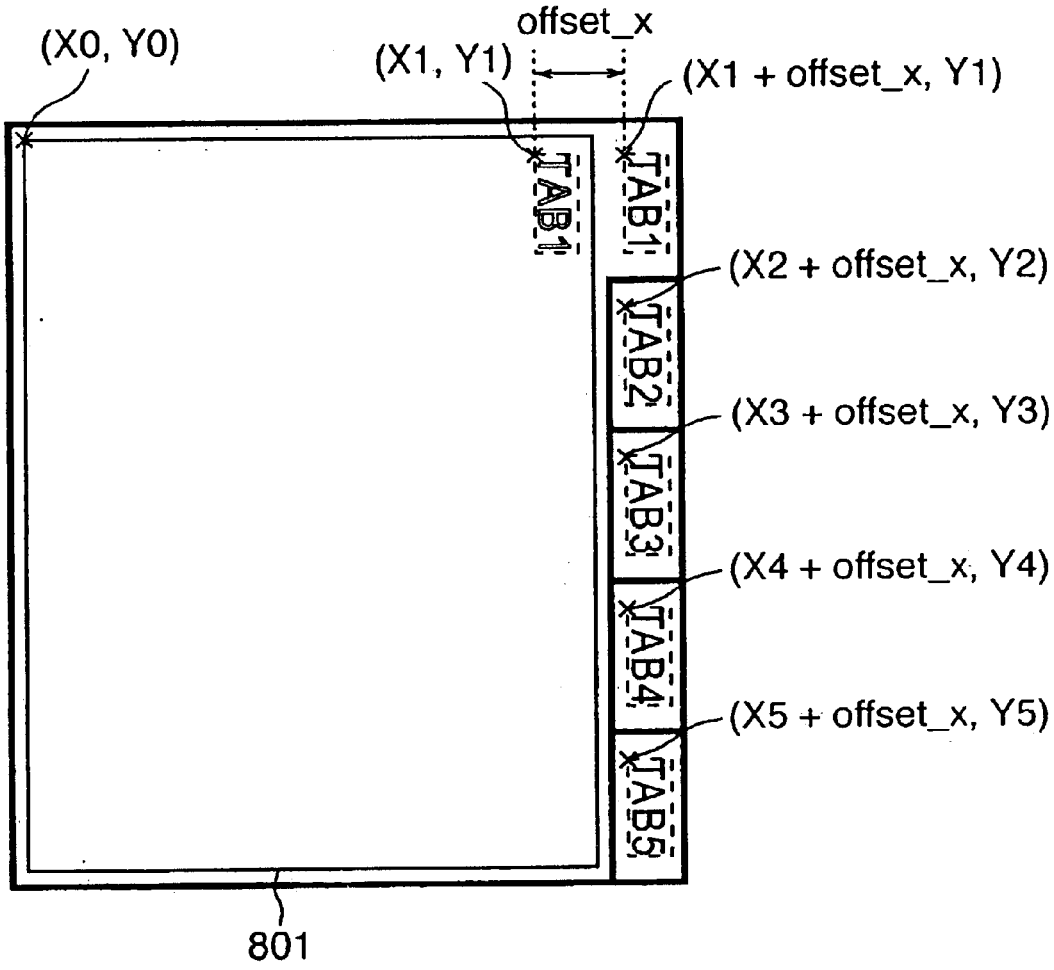
FIG. 8 is a view for explaining drawing data on tab paper documents.

In step 608, the spool file manager 304 saves information such as a logical page number which forms a physical page which is ready to print in the format shown in FIG. 8, its physical page number, and the like in a job output setup file (a file containing physical page information), and informs the despooler 305 that the physical page information for one physical page is added.

The flow then returns to step 601 to wait for the next message. In this embodiment, when print data for one page, i.e., a logical page or pages which forms or form one physical page has or have been spooled, a print process can be started even when spooling of all print jobs is not complete.

On the other hand, if it is determined in step 604 that the progress message is not a print end message of one logical page from the spooler 302, the flow advances to step 609, and the spool file manager 304 checks if the progress message is a job end message sent from the spooler 302 in step 512 above. If YES in step 609, the flow advances to step 606 above; otherwise, the flow advances to step 610, and the spool file manager 304 checks if the received message is a print end message of one physical page from the despooler 305.

If it is determined in step 604 that the progress message is a print end message of one physical page, the flow advances to step 611 to check if a print process for all pages designated by the process setups is complete. If YES in step 611, the flow advances to step 612, and the spool file manager 304 informs the despooler 305 of the end of the print process. On the other hand, if pages to be printed designated by the process setups still remain, the flow advances to step 606 above.

The despooler 305 of this embodiment assumes one physical page as a unit of a print process to be executed. In step 608, information required to execute a print process of one physical page is sequentially saved in a file in a re-usable format. If such information need not be re-used, information for one physical page is overwritten in turn on a high-speed medium such as a shared memory, thus saving the time and resources.

If the progress of spooling is faster than that of despooling, or if despooling starts after completion of spooling of all pages, a page printable message is not sent for each physical page in step 608, and a message indicating that a plurality of or all physical pages are ready to print may be sent in accordance with the progress on the despooler side, thus reducing the number of messages to be sent.

If it is determined in step 610 that the progress message is not a print end message of one physical page from the despooler 305, the flow jumps to step 613, and the spool file manager 304 checks if the progress message is a print end message from the despooler 305. If YES in step 613, the flow advances to step 614, and the spool file manager 304 deletes the corresponding page drawing file to end the process. On the other hand, if the progress message is not a print end message from the despooler 305, the flow advances to step 615 to execute another normal process, thus waiting for the next message.

<Output of Spool File>

Figure 7:
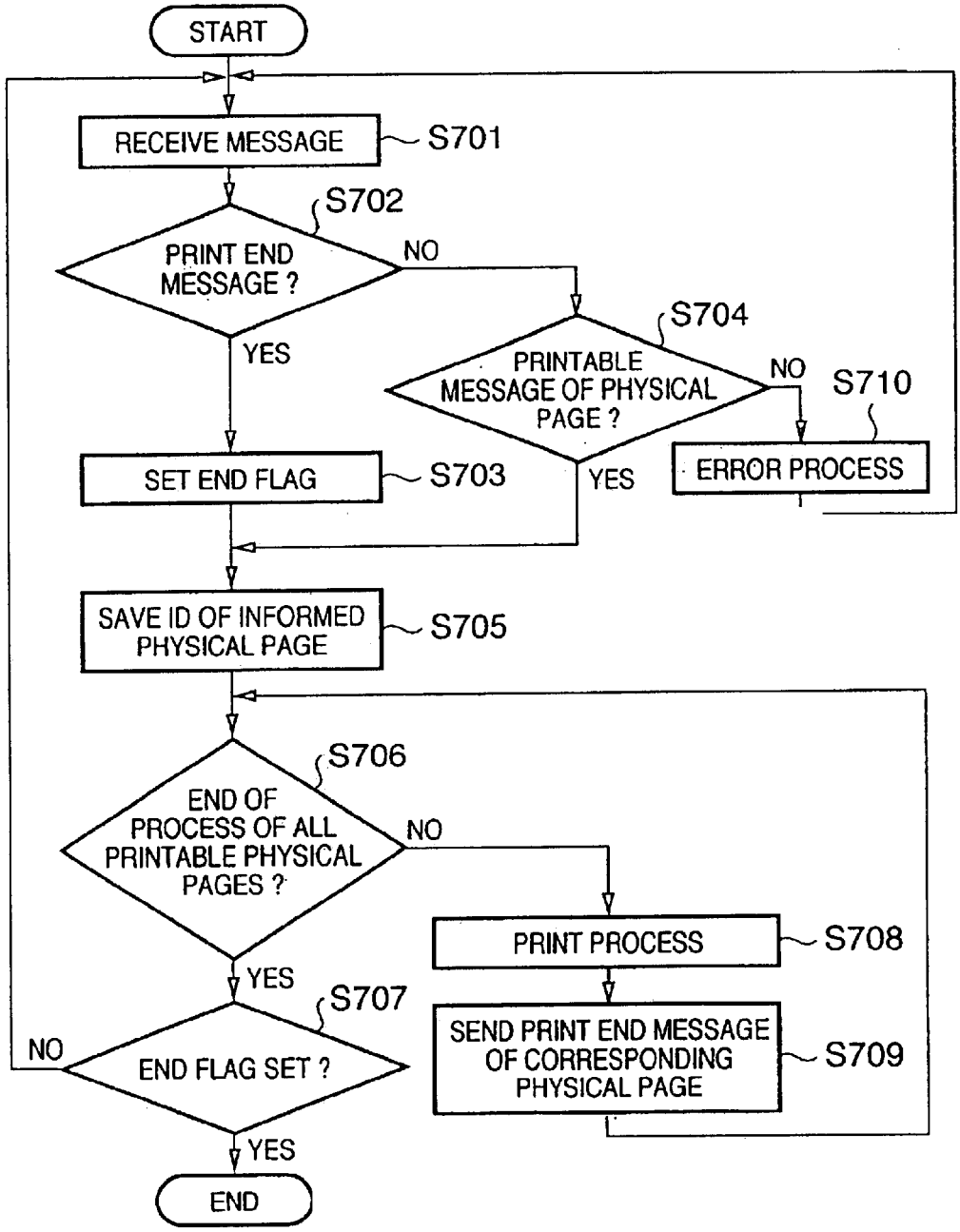
FIG. 7 is a flow chart showing the process in a despooler 305.

FIG. 7 is a flow chart showing details of the generation process of print data in the despooler 305.

The despooler 305 reads out necessary information (page drawing file and job setup file) from the spool file 303 in response to a print request from the spool file manager 304, and generates print data. The method of transferring the generated print data to the printer has been explained using FIG. 3.

Upon generating print data, the despooler 305 receives a message from the aforementioned spool file manager 304 in step 701. The despooler 305 checks in step 702 if the received message is a job end message. If YES in step 702, the flow advances to step 703 to set an end flag, and the flow then advances to step 705.

On the other hand, if it is determined in step 702 that the received message is not a job end message, the flow advances to step 704 to check if the message is a print start request of one physical page sent in step 608. If NO in step 704, the flow advances to step 710 to execute an error process. The flow then returns to step 701 to wait for the next message.

If it is determined in step 704 that the message is a print start request of one physical page, the flow advances to step 705, and the despooler 305 saves the ID of a physical page that can undergo a print process and is designated by the message in step 704. The despooler 305 checks in step 706 if a print process of all pages corresponding to the physical page IDs saved in step 705 is complete.

If the process for all physical pages is complete, the flow advances to step 707 to check if the end flag is set in step 703. If the end flag is set, the despooler 305 determines that the print process of the job is complete, and sends its process end message to the spool file manager 304, thus ending the process. If it is determined in step 707 that no end flag is set, the flow returns to step 701 to wait for the next message. On the other hand, if it is determined in step 706 that printable physical pages still remain, the flow advances to step 708. In step 708, the despooler 305 reads out a non-processed physical page ID from the saved physical page IDs in turn, reads information required to generate print data of a physical page corresponding to the readout physical page ID, and executes a print process.

In the print process, the despooler 305 converts a print request command stored in the spool file 303 into a format (GDI function) that the graphic engine 202 can recognize, and transfers the converted command. As for process setups that designate to lay out a plurality of logical pages on one physical page (to be referred to as N-page print setups hereinafter), conversion is made in this step in consideration of a reduced-scale layout.

Upon completion of the required print process, the despooler 305 sends a print data generation end message of one physical page to the spool file manger 304 in step 709. The flow then returns to step 706 to repeat the print process for all the printable physical page IDs saved in step 705.

The flow of print processes using the dispatcher 301, spooler 302, spool file manager 304, and despooler 305 has been explained. With the above processes, since the application 201 is released from the print process at the timing when the spooler 302 generates an intermediate code and stores it in the spool file 303, the processing time can be shorter than that required when the application directly outputs data to the printer driver 203.

<Configuration of Job Output Setup File>

Figure 10:
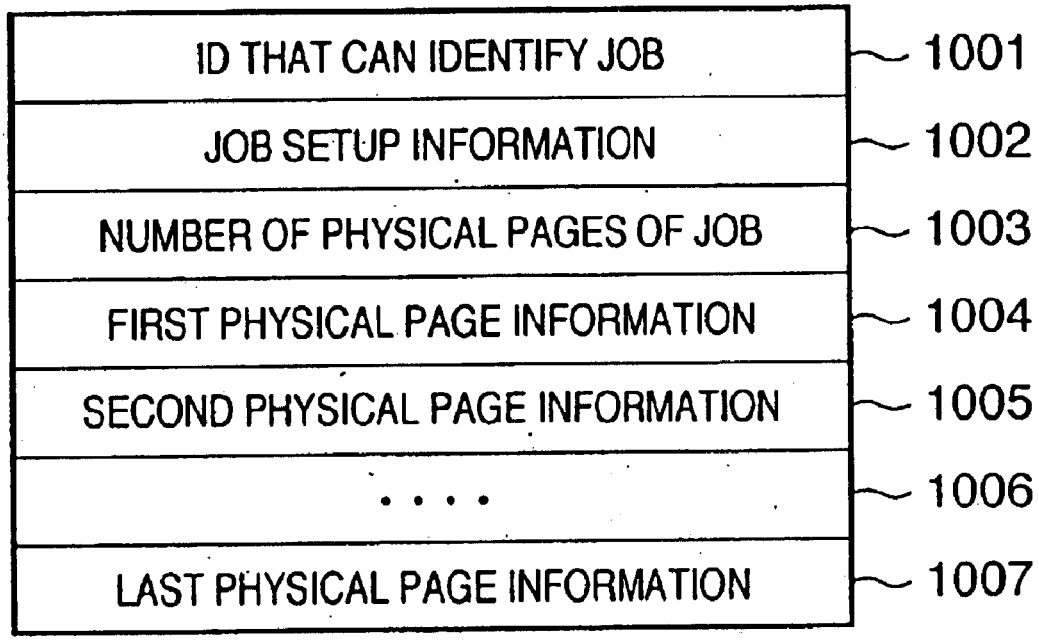
FIG. 10 shows an example of the data format to be passed upon issuing a print request of physical pages from the spool file manager 304 to the despooler 305.

FIG. 10 shows an example of a job output setup file which is generated by the spool file manager 304 in step 608 and saves information that forms a printable physical page. A field 1001 stores an ID used to identify a job, and may hold a file name or the name of a shared memory that saves this information. A field 1002 stores job setup information.

The job setup information contains a structure required to start a job print process with respect to the graphic engine 202, tab paper print setups of the present invention, designation of N-page print setups, designation of additional drawing such as a page frame, finishing designation such as the number of copies, stapling, and the like, and so forth, i.e., information that can be set one each per job. The job setup information field 1002 saves a required number of pieces of information in correspondence with functions for a job.

A field 1003 stores the number of physical pages of a job, i.e., indicates that a plurality of pieces of physical page information designated by this number are saved after this field. Since this embodiment informs the number of printable physical pages, an operation can be made without this field. After this field, a plurality of pieces of physical page information are stored from a field 1004 to the last field in correspondence with the value stored in the field 1003. Physical page information will be described later using FIG. 12.

FIG. 11 shows an example of the job setup information shown in the field 1002 of FIG. 10. A field 1101 stores the total number of physical pages. A field 1102 stores the total number of logical pages. The fields 1101 and 1102 are used when the number of pages and the like are to be printed as additional information of print data. When a print process continues, these fields stores tentative values or the spool file manager 304 postpones generation of information of printable physical pages until completion of the print process.

A field 1103 stores copy set count information which designates the number of sets of copies to be printed of this print job. A field 1104 designates whether or not a print process is to be made for each set of copies if the field 1103 sets to print a plurality of sets of copies. A field 1105 stores finishing information such as stapling, punch, Z-fold, or the like, and is designated when a finisher is available on the printer main body or externally.

A field 1106 stores additional print information, i.e., saves information to be added to a job such as ornaments (e.g., page frame), additional information (e.g., date), a user name, a page count, watermark print, and the like. The number of fields included in this job setup information increases with increasing number of functions. For example, if a 2-sided print function is available, a field for saving designation of the 2-sided print function is added.

Figure 12:
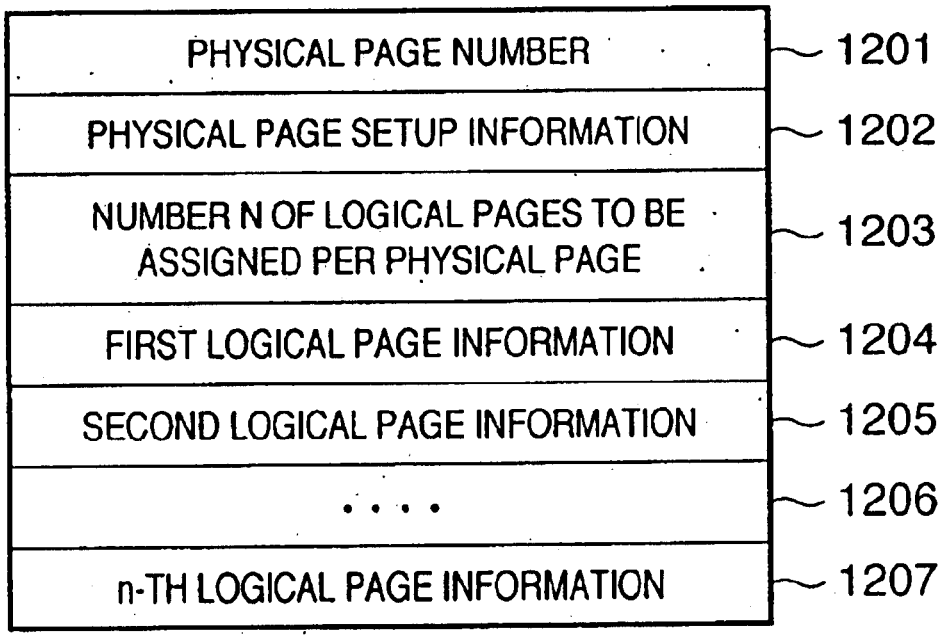
FIG. 12 shows an example of the data format to be passed upon issuing a print request of physical pages from the spool file manager 304 to the despooler 305.

FIG. 12 shows an example of physical page information shown in the field 1004 in FIG. 10. A first field 1201 stores a physical page number, which value is used upon managing the print order or additionally printing a physical page number. A field 1202 stores physical page setup information. When a layout or color/monochrome setup can be designated for each physical page, this field stores a layout or color/monochrome setup.

A field 1203 stores the number of logical pages to be assigned to this physical page. When four pages are assigned to one physical page, this field saves "4" or an ID indicating a 4-page print mode. A field 1204 and subsequent fields save information of logical pages in correspondence with the number designated in the field 1203.

Depending on the number of pages printed from the application 201, the number of pages designated in the field 1203 becomes often smaller than the number of actual page data. Such case is coped with by saving special data indicating a blank page in logical page information. However, in the tab paper print function of the present invention, the number of logical pages per physical page is 1.

Figure 13:
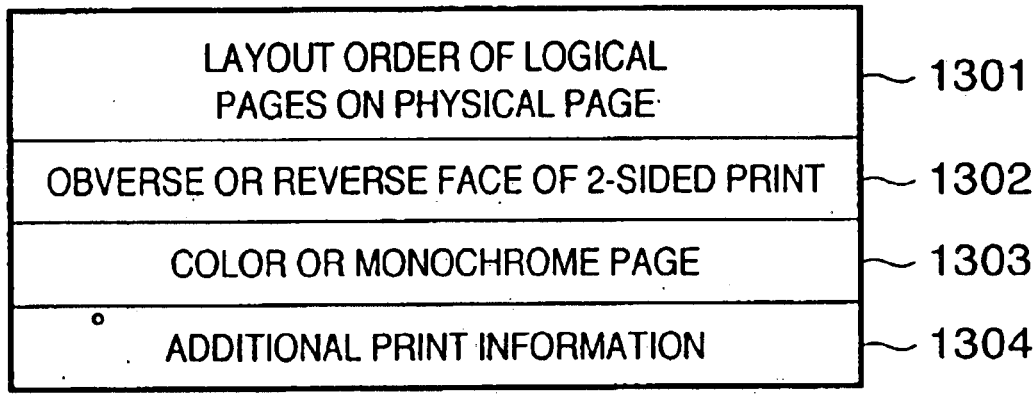
FIG. 13 shows an example of the data format to be passed upon issuing a print request of physical pages from the spool file manager 304 to the despooler 305.

FIG. 13 shows an example of physical page setup information in the field 1202. A field 1301 stores a layout order of logical pages on a physical page, i.e., saves designation of a layout order of logical pages (from upper left to right, from upper left to lower, and the like) on a physical page in the N-page print function. In some systems, such layout order field is not used, and the field 1204 and subsequent fields that store logical page information are arranged not in an order of page numbers but in a layout order, in place of the setup in the field 1301.

A field 1302 stores obverse/reverse information of the 2-sided print function. In the present invention, the obverse face of a tab paper sheet is printed first, and the reverse face of the tab paper sheet is then printed. In such case, a value indicating the obverse face is stored upon printing on the tab obverse face, and a value indicating the reverse face is substituted upon printing on the tab reverse face.

In addition, the field 1302 is used upon adjusting, e.g., binding margins on the obverse and reverse faces. A field 1303 stores designation indicating a color or monochrome page. If a printer has monochrome and color modes, the value in this field is used when a color page of a document which includes both color and monochrome pages is to be printed in the color mode, and a monochrome page of this document is to be printed in the monochrome mode.

With this information, a color printer can change processes for respective pages as an auto color mode. That is, transfer control can be made by rotating an intermediate transfer member (intermediate transfer drum or belt) or a transfer member (transfer drum or belt) in correspondence with the number of device colors (four in case of YMCK) for a color page, and by rotating it once for black of a monochrome page.

A field 1304 stores additional print information which is used upon printing additional information such as a page count, date, or the like is to be printed on a physical page. In the physical page setup information, fields are added in correspondence with system functions.

Figure 14:
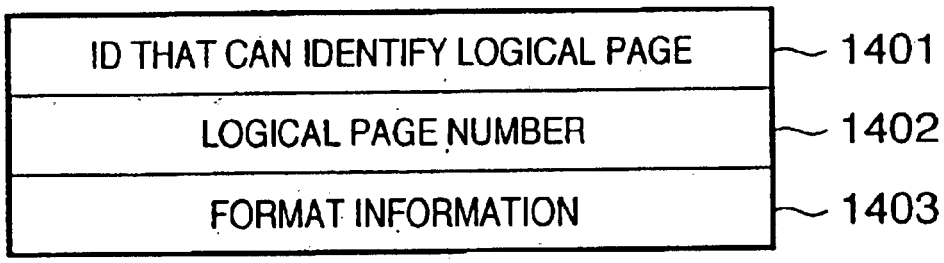
FIG. 14 shows an example of the data format to be passed upon issuing a print request of physical pages from the spool file manager 304 to the despooler 305.

FIG. 14 shows an example of logical page information in the field 1204. A field 1401 stores an ID of a logical page. Using this ID, an intermediate code of a page drawing file corresponding to the logical page is referred to from the spool file 303. The intermediate code of a logical page need only be accessed using this ID, and a file or memory pointer, or the intermediate code itself that forms a logical page may be stored.

A field 1402 stores a logical page number, which is used when the logical page number is printed as additional information or as auxiliary information of the logical page ID. Format information in a field 1403 saves various setup items which can be designated for each logical page. For example, additional print information such as a page frame or the like, and various kinds of setup information such as an enlargement/reduction factor and the like, which are set for each logical page, are saved. Also, attribute information for a logical page such as color/monochrome information for each logical page can be saved if necessary. Conversely, in a system which need not change setups for respective logical pages or does not require any attribute information for each logical page, the field 1403 may be omitted.

The job output setup file has the aforementioned configuration. Note that a job setup file has nearly the same configuration, and has a print style (1-sided, 2-sided, bookbinding print), print layout (tab paper print, Nup, poster print), additional information (addition of watermark, date, user name), the number of copies, and paper size information as a job, and also the layout order of logical pages, obverse/reverse face information of the 2-sided print function, color mode, and the like for each physical page.

<Process Required to Implement 2-Sided Print Function on Tab Paper Using Single Document>

A process required to implement the 2-sided print function on a tab paper sheet using a single document will be described in detail below.

The operation of the spool file manager 304 will be explained taking the 2-sided tab print process on 5-tab paper sheets. The spool file manager 304 generates physical page information to be printed in steps 607 and 608 in FIG. 6. In the example of the 2-sided tab print process on 5-tab paper sheets, print data for 10 physical pages are generated. In the first to fifth physical pages, the field 1302 in FIG. 13 stores a value indicating the obverse face.

Since the sixth to 10th physical pages correspond to print data for the reverse face, the field 1302 stores a value indicating the reverse face. The sixth to 10th physical pages are generated when the number of pages to be printed is determined in step 609 (spool end message from the spooler 302) in FIG. 6.

FIG. 8 is a view for explaining drawing data on a tab paper document. Normally, a tab paper document for each page is prepared within an effective print region 801 of an A4 or letter document size. That is, five pages of documents are prepared for 5-tab paper sheets, and 10 pages of documents are prepared for 10-tab paper sheets.

As shown in FIG. 8, data to be printed on a tab portion has a reference coordinate position (X1, Y1) with respect to an origin (X0, Y0) of the effective print region. In case of text data like in this embodiment, a coordinate position is normally expressed using a reference value of a character string. In this case, the reference value may indicate the upper/lower left corner of a character string rectangle or the baseline of a character design depending on the OS specifications on which a program that implements the present invention runs. However, the reference value is not particularly limited in the present invention.

Upon executing a tab print process, when the printing apparatus recognizes an offset value offset_x with respect to a document, a print document is offset by a numerical value of offset_x with respect to the document, and is printed on a tab portion. This offset_x may be set from a user interface provided by the program of the present invention or that provided by the printing apparatus (printer). Alternatively, offset_x may be a fixed value unique to the printing apparatus.

Figure 9:
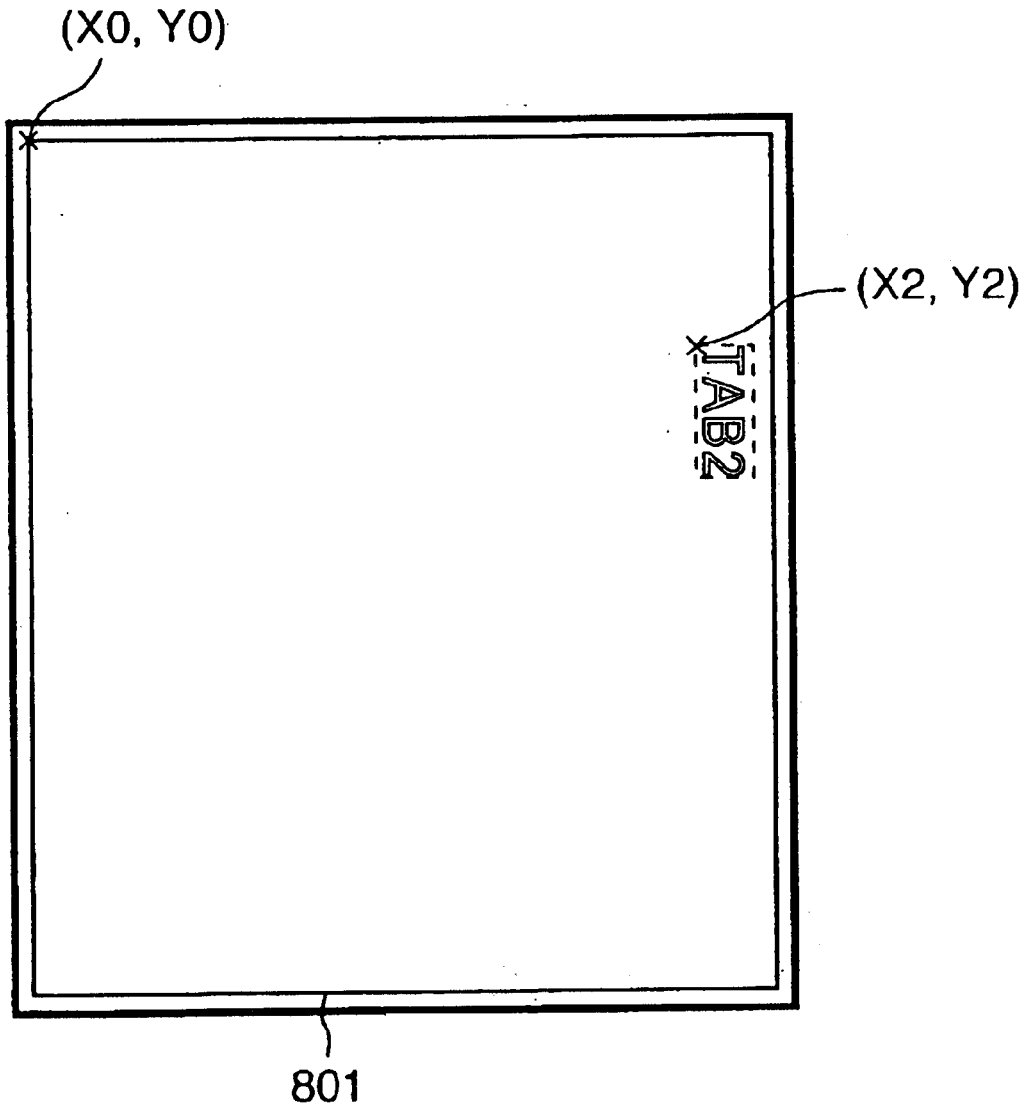
FIG. 9 shows an example of a tab document of the second page.

Hence, in the tab paper document print process, the coordinate position of an object to be laid out on each page, and the offset value may be independently considered. FIG. 8 illustrates a tab document for the first page. Documents for the second and subsequent pages are laid out and prepared so that they can fall within corresponding tab ranges by shifting their positions by offset_x, as shown in FIG. 9.

Figure 15:
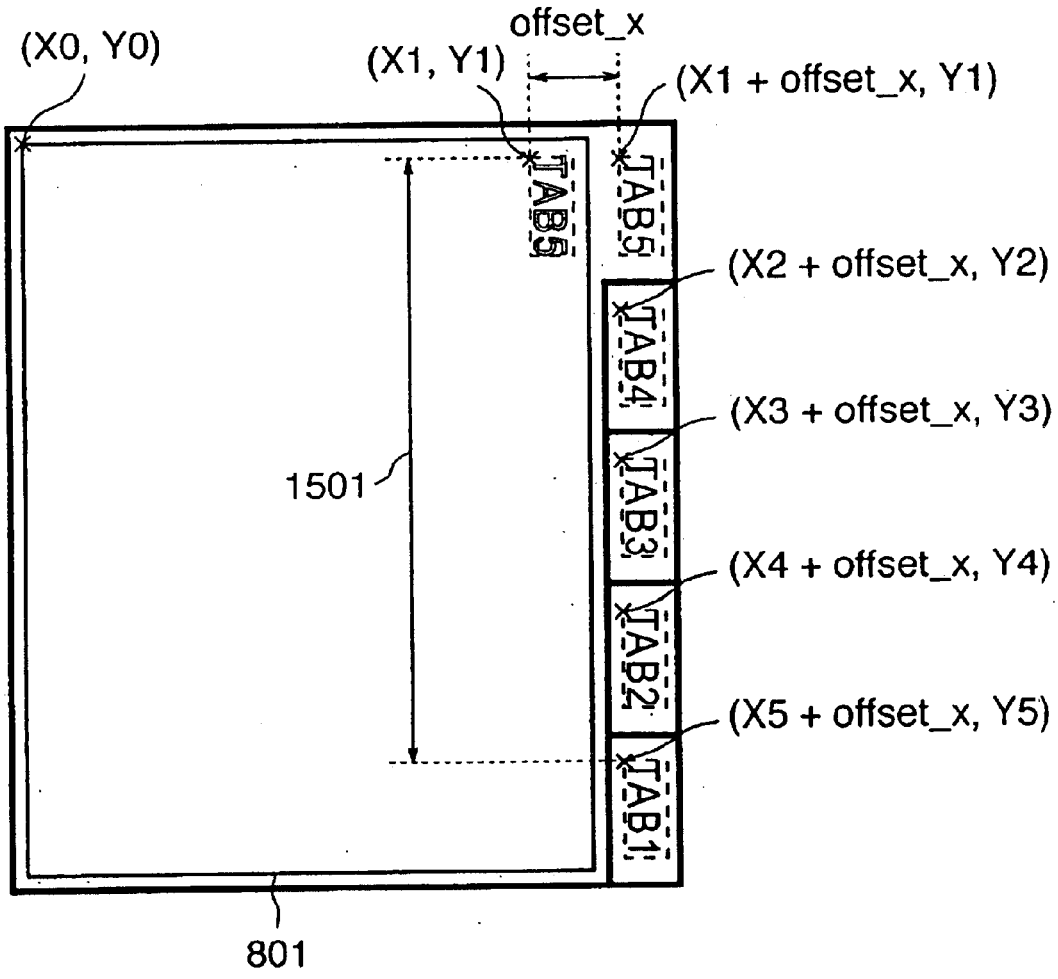
FIG. 15 is a view for explaining coordinate conversion of the first and fifth pages in a coordinate calculation upon printing on the reverse faces of tab paper sheets in the embodiment of the present invention.

FIG. 15 is a view for explaining the coordinate conversion of the first and fifth pages in a coordinate calculation upon printing on the reverse faces of tab paper sheets. Let n be the number of tabs, i.e., the total number of pages of documents, and the k-th page be the current document to be printed. Then, an offset value offset_y of print data for the reverse face can be calculated by:

$$\text{Offset_}y=Y(n+1-k)-Y(k) \quad (1)$$

where Y(k) is the Y-coordinate value of a print object stored in the k-th physical page. That is, upon executing the drawing process in the despooler 305 (step 708 in FIG. 7), print data is generated in consideration of the aforementioned adjustment value with respect to the Y-coordinate value of drawing data.

In case of FIG. 15, since Offset_y=Y(5+1−5)−Y(5), a value obtained by subtracting the Y-coordinate value of TAB5 from that of TAB1 is used as an offset value. In the drawing process of the despooler 305, print data is generated by shifting drawing data of TAB5 by a value 1501.

Figure 16:
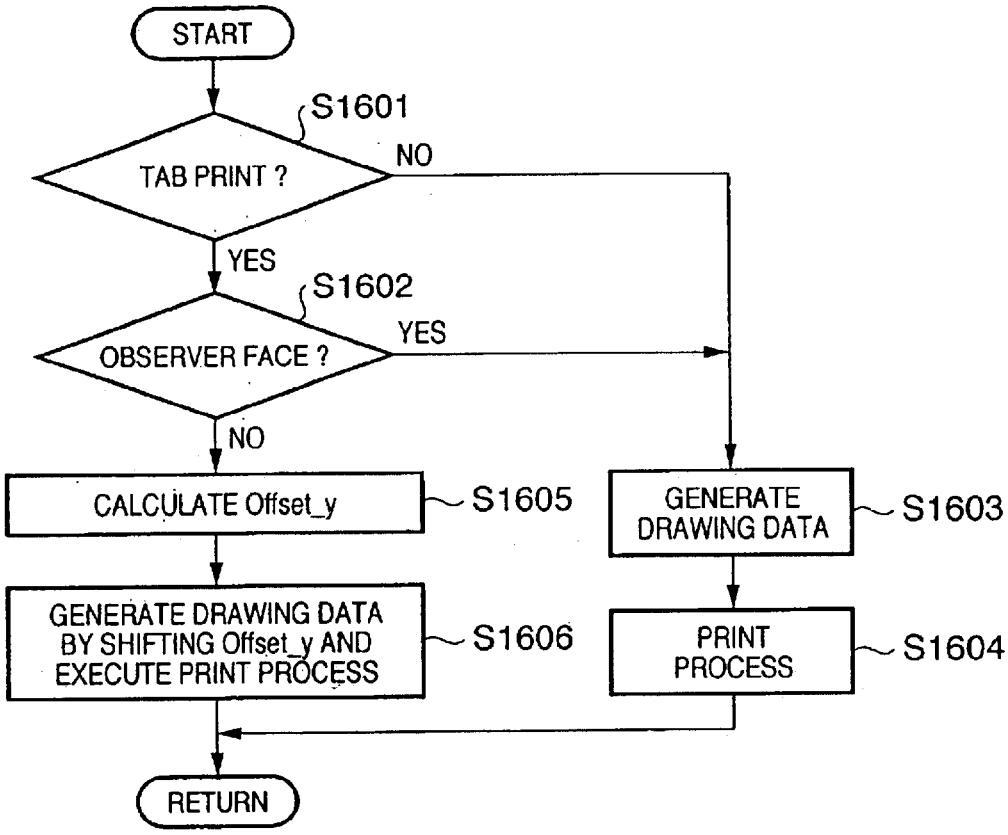
FIG. 16 is a flow chart showing the process in step 708 in FIG. 7 of the despooler 305.

FIG. 16 is a flow chart showing the process in step 708 of FIG. 7 in the despooler 305.

It is checked in step 1601 based on the user setups corresponding to FIG. 18 if a tab paper print mode is set. If a print mode using a normal print sheet is selected in place of the tab paper print mode, the flow advances to step 1603 to generate drawing data. After that, a print process on that print sheet is executed in step 1604.

On the other hand, if it is determined in step 1601 that the tab paper print mode is set, the flow advances to step 1602 to check if the obverse face of a physical page is to undergo a print process. If YES in step 1602, the process in the despooler 305 is the same as that on a normal print sheet, and the flow advances to step 1603 to execute the normal print process. In this case, drawing data corresponding to FIGS. 8 and 9 is generated in step 1603.

On the other hand, if it is determined in step 1602 that the reverse face is to undergo a print process, the flow advances to step 1605 to execute a tab paper reverse face print process. In step 1605, Offset_y is calculated by equation (1) above. In step 1606, drawing data is generated using a coordinate value shifted by Offset_y, and a print process is done based on that data.

With the above process, a 2-sided print function on a tab paper sheet can be implemented using a single document.

[Second Embodiment]

The first embodiment has assumed a single object and text data. However, since a tab print region depends on a paper sheet, an object other than text data and a plurality of objects can be handled by a method of calculating a given value as an offset value on the basis of the paper size and the number of tabs.

Figure 17:
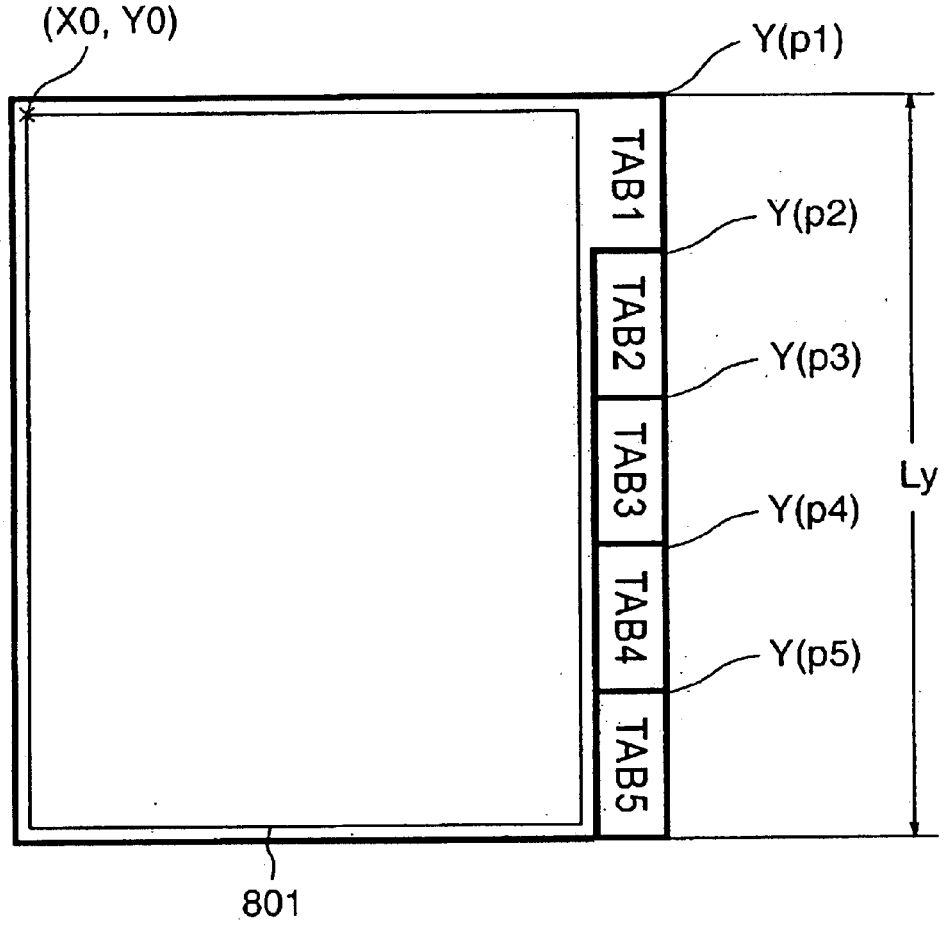
FIG. 17 shows offset values used in a reverse-face tab print mode in the second embodiment.

More specifically, in the calculation of Offset_y in the first embodiment, the value of Y(k) uses a coordinate value Y(pk) indicating a region of the tab paper sheet itself in the Y-axis direction, as shown in FIG. 17, in place of print data.

Since FIG. 17 exemplifies 5-tab paper sheets, Y(p1) to Y(p5) are available. As a practical calculation method, let n be the number of tabs, and Ly be paper size information. Then, reference coordinate value Y(pk) of the k-th tab (k) and offset value Offset_y are calculated by:

$$Y(pk)=(k-1)*Ly/n \quad (2)$$

$$\text{Offset_}y=Y(p(n+1-k))-Y(pk) \quad (3)$$

When Offset_y calculated by equation (3) is used in the process described in the first embodiment, the 2-sided print function on a tab paper sheet can be similarly implemented using a single document.

As described above, the 2-sided print function on a tab paper sheet can be implemented on the basis of a single layout without preparing two different layouts, i.e., a tab layout for the obverse face and that for the reverse face, and a tab paper print control method that the user wants can be provided.

[Other Embodiment]

The present invention can be applied to a system constituted by a plurality of devices (e.g., host computer, interface, reader, printer) or to an apparatus comprising a single device (e.g., copying machine, facsimile machine)

Further, the object of the present invention can also be achieved by providing a storage medium storing program codes for performing the aforesaid processes to a computer system or apparatus (e.g., a personal computer), reading the program-codes, by a CPU or MPU of the computer system or apparatus, from the storage medium, then executing the program.

In this case, the program codes read from the storage medium realize the functions according to the described embodiments and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above described embodiments are realized by executing the program codes which are read by a computer, the present invention includes a case where an OS (operating system) or the like working on the computer performs a part or entire processes in accordance with designations of the program codes and realizes functions according to the above described embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above described embodiments.

In a case where the present invention is applied to the aforesaid storage medium, the storage medium stores program codes corresponding to the flowcharts described in the embodiments. The present invention is not limited to the above embodiments and various changes and modifications can be made within the spirit and scope of the present invention. Therefore to apprise the public of the scope of the present invention, the following claims are made.

It is thus believed that the operation and construction of the present invention will be apparent from the foregoing description. While the method, apparatus and system shown and described has been characterized as being preferred, it will be readily apparent that various changes and modifications could be made therein without departing from the scope of the invention as defined in the following claims.

What is claimed is:

1. A tab paper 2-sided print method comprising:

a print setup checking step of checking if a tab paper print setup is made;

a print face checking step of checking, when it is determined that the tab paper print setup is made, if a face to be printed is an obverse or reverse face; and a drawing data generation step of generating first drawing data when it is determined that the face to be printed is the obverse face, and generating second drawing data by adjusting the first drawing data when it is determined that the face to be printed is the reverse face.

2. The method according to claim 1, wherein the drawing data generation step includes a step of generating the first and second drawing data from identical input data.

3. The method according to claim 1, wherein the drawing data generation step includes a step of generating the second drawing data by adjusting a coordinate value of the first drawing data.

4. The method according to claim 3, wherein the drawing data generation step includes a step of determining the coordinate value of the first drawing data on the basis of a physical size of the tab paper.

5. A tab paper 2-sided print program for making a computer execute a tab paper 2-sided print method of claim 1.

6. A computer readable storage medium storing a tab paper 2-sided print program for making a computer execute a tab paper 2-sided print method of claim 1.

7. A print control apparatus comprising:

a print setup checking unit configured to check if a tab paper print setup is made;

a print face checking unit configured to check if a face to be printed is an obverse or reverse face, when it is determined that the tab paper print setup is made; and a drawing data generation unit configured to generate first drawing data when it is determined that the face to be printed is the obverse face, and to generate second drawing data by adjusting the first drawing data when it is determined that the face to be printed is the reverse face.

8. The apparatus according to claim 7, wherein said drawing data generation unit generates the first and second drawing data from identical input data.

9. The apparatus according to claim 7, wherein said drawing data generation unit generates the second drawing data by adjusting a coordinate value of the first drawing data.

10. The apparatus according to claim 9, wherein said drawing data generation unit determines the coordinate value of the first drawing data on the basis of a physical size of the tab paper.

* * * * *